US011896133B2

(12) United States Patent
Alletto

(10) Patent No.: US 11,896,133 B2
(45) Date of Patent: Feb. 13, 2024

(54) PERFORMANCE BED SHEETS

(71) Applicant: BEDGEAR, LLC

(72) Inventor: Eugene Alletto, Glen Head, NY (US)

(73) Assignee: BEDGEAR, LLC, Farmingdale, NY (US)

( * ) Notice: Subject to any disclaimer, the term of this patent is extended or adjusted under 35 U.S.C. 154(b) by 0 days.

(21) Appl. No.: 17/470,272

(22) Filed: Sep. 9, 2021

(65) Prior Publication Data

US 2021/0401186 A1 Dec. 30, 2021

Related U.S. Application Data

(63) Continuation of application No. 16/704,364, filed on Dec. 5, 2019, now Pat. No. 11,534,005, which is a continuation of application No. 16/028,929, filed on Jul. 6, 2018, now Pat. No. 10,531,744, which is a continuation of application No. 15/703,538, filed on Sep. 13, 2017, now Pat. No. 10,034,552, which is a continuation of application No. 15/141,223, filed on Apr. 28, 2016, now Pat. No. 9,788,661.

(51) Int. Cl.
*A47C 21/04* (2006.01)
*A47G 9/02* (2006.01)

(52) U.S. Cl.
CPC ..... *A47C 21/046* (2013.01); *A47C 21/042* (2013.01); *A47G 9/0238* (2013.01); *A47C 21/04* (2013.01); *A47G 9/02* (2013.01)

(58) Field of Classification Search
CPC ..... A47G 9/00; A47G 9/02; A47G 9/0207; A47G 9/0223; A47G 9/0238; A47G 9/0246; A47C 31/00; A47C 31/10; A47C 31/105; A47C 21/046; A47C 21/042; D04B 1/22; D04B 21/10; D04B 21/12; D04B 21/14; D04B 21/16; D04B 21/18; D04B 21/20
USPC ..... 5/495, 497, 499, 482; 66/190–195
See application file for complete search history.

(56) References Cited

U.S. PATENT DOCUMENTS 2,804,632 A 9/1957 Ford
4,648,186 A 3/1987 Dolman et al.
4,690,859 A 9/1987 Porter et al.
5,065,600 A * 11/1991 Byles ..... D04B 21/04 66/193

(Continued)

FOREIGN PATENT DOCUMENTS

AU 2009296195 4/2010
AU 2012202375 5/2012

(Continued)

OTHER PUBLICATIONS

European Patent Office Communication pursuant to Article 94(3) EPC dated Feb. 18, 2020, European Patent Application No. 17 733173.3—"Performance Bed Sheets" in the name of Bedgear, LLC.

(Continued)

*Primary Examiner* — Robert G Santos
(74) *Attorney, Agent, or Firm* — Sorell, Lenna & Schmidt, LLP

(57) ABSTRACT

A bed sheet is provided that includes a knitted performance fabric having a plurality of spaced apart ventilation ports. The knitted performance fabric has a gauge per square inch, grams per square meter, air permeability and material content that are pre-selected to provide the knitted performance fabric with one or more selected physical features.

27 Claims, 11 Drawing Sheets

(56) References Cited

U.S. PATENT DOCUMENTS

| | | | | |
|---|---|---|---|---|
| 5,092,088 | A | 3/1992 | Way | |
| 5,165,128 | A | 11/1992 | Honig | |
| 5,636,380 | A | 6/1997 | Schindler et al. | |
| 5,765,241 | A | 6/1998 | MacDonald | |
| 5,817,391 | A | 10/1998 | Rock et al. | |
| 5,870,785 | A * | 2/1999 | Hoorens | D04B 21/12 5/724 |
| 5,884,349 | A | 3/1999 | Gretsinger | |
| 6,381,779 | B1 | 5/2002 | Thompson | |
| 6,823,548 | B2 | 11/2004 | Murphy et al. | |
| 6,883,193 | B2 | 4/2005 | Brooks et al. | |
| 7,117,695 | B2 | 10/2006 | Laycock et al. | |
| 7,176,419 | B2 | 2/2007 | Ellis et al. | |
| 7,240,383 | B2 | 7/2007 | Stewart | |
| 7,325,263 | B2 | 2/2008 | Stribling | |
| 7,428,772 | B2 | 9/2008 | Rock | |
| 8,171,581 | B2 | 5/2012 | Agarwall | |
| 8,402,580 | B2 | 3/2013 | Walvius et al. | |
| 8,566,982 | B2 | 10/2013 | Walvius et al. | |
| 9,109,309 | B2 | 8/2015 | Walvius et al. | |
| 9,788,661 | B1 * | 10/2017 | Alletto | A47C 21/042 |
| 10,034,552 | B2 * | 7/2018 | Alletto | A47G 9/0238 |
| 10,531,744 | B2 * | 1/2020 | Alletto | D04B 1/104 |
| 10,799,045 | B2 * | 10/2020 | Alletto, Jr. | A47G 9/0253 |
| 11,116,337 | B2 * | 9/2021 | Alletto, Jr. | A47G 9/0253 |
| 11,206,937 | B2 * | 12/2021 | Alletto, Jr. | A47G 9/0246 |
| 11,534,005 | B2 * | 12/2022 | Alletto | A47C 21/042 |
| 2005/0132754 | A1 | 6/2005 | Taniguchi et al. | |
| 2005/0273930 | A1 | 12/2005 | Phillipps | |
| 2005/0284189 | A1 | 12/2005 | Stewart | |
| 2007/0151028 | A1 | 7/2007 | Bauer | |
| 2007/0266495 | A1 | 11/2007 | Stribling | |
| 2007/0283493 | A1 | 12/2007 | Link et al. | |
| 2008/0028523 | A1 | 2/2008 | Robertson et al. | |
| 2011/0000020 | A1 | 1/2011 | Walvius et al. | |
| 2012/0024013 | A1 | 2/2012 | Walvius et al. | |
| 2012/0030874 | A1 | 2/2012 | Walvius et al. | |
| 2017/0311730 | A1 * | 11/2017 | Alletto | A47G 9/0238 |
| 2017/0354276 | A1 * | 12/2017 | Alletto, Jr. | A47G 9/0246 |
| 2018/0035818 | A1 * | 2/2018 | Alletto | A47C 21/046 |
| 2018/0303257 | A1 * | 10/2018 | Alletto, Jr. | A47G 9/10 |
| 2018/0310717 | A1 * | 11/2018 | Alletto | A47C 21/042 |
| 2019/0282005 | A1 * | 9/2019 | Alletto, Jr. | A47G 9/04 |
| 2020/0107647 | A1 * | 4/2020 | Alletto | A47C 21/042 |
| 2021/0401186 | A1 * | 12/2021 | Alletto | D04B 1/104 |
| 2022/0079357 | A1 * | 3/2022 | Alletto, Jr. | A47G 9/04 |
| 2023/0200552 | A1 * | 6/2023 | Alletto, Jr. | A47C 21/046 5/495 |

FOREIGN PATENT DOCUMENTS

| | | | | |
|---|---|---|---|---|
| CA | 2738658 | | 9/2013 | |
| CA | 3061316 | A1 * | 11/2018 | A47G 9/0253 |
| CA | 3016915 | C * | 4/2020 | A47C 21/046 |
| CN | 2456671 | | 10/2001 | |
| CN | 200520014944.0 | | 9/2005 | |
| CN | 2841696 | | 11/2006 | |
| CN | 101155847 | | 4/2008 | |
| CN | 1308150 | | 8/2011 | |
| CN | 102245822 | | 11/2011 | |
| CN | 102551442 | | 7/2012 | |
| EP | 2344691 | | 7/2011 | |
| EP | 2601866 | | 6/2013 | |
| EP | 4233645 | A2 * | 8/2023 | A47C 21/046 |
| ES | 2368481 | | 11/2011 | |
| HK | 1173055 | | 5/2013 | |
| JP | 8256891 | | 10/1996 | |
| JP | 11309183 | | 9/1999 | |
| WO | 2006086715 | | 8/2006 | |
| WO | 2010037082 | | 4/2010 | |
| WO | 2014150901 | | 9/2014 | |
| WO | WO-2017189992 | A1 * | 11/2017 | A47C 21/046 |
| WO | WO-2017214142 | A1 * | 12/2017 | A47G 9/0246 |
| WO | WO-2019178497 | A1 * | 9/2019 | A47G 9/0253 |

OTHER PUBLICATIONS

Australian office action from Australian application No. 2009296195, dated Mar. 28, 2013.

International Search Report from PCT application No. PCT/US2009/058716 dated Apr. 29, 2010 (3 pages).

International Preliminary Report on Patentability from PCT application No. PCT/US2009/058716 dated Apr. 7, 2011 (5 pages).

Written Opinion from PCT application No. PCT/US2009/058716 dated Apr. 29, 2010 (4 pages).

Australian office action from Australian application No. 2012202375, dated Nov. 20, 2012.

Voluntary Amendment filed in Australian Application No. 2009296195 filed Apr. 24, 2012 (12 pages).

European Patent Office, Postbus 5818, 2280 HV Rijswijk, Netherlands, Communication pursuant to Article 94(3) EPC, Application No. 17733173.3, dated Sep. 19, 2022.

* cited by examiner

PERFORMANCE BED SHEETS

CROSS-REFERENCE TO RELATED APPLICATIONS

This application which is a continuation application of U.S. patent application Ser. No. 16/704,364, filed Dec. 5, 2019, which is a continuation application of U.S. patent application Ser. No. 16/028,929, filed Jul. 6, 2018, which is a continuation application of U.S. patent application Ser. No. 15/703,538, filed Sep. 23, 2017, now U.S. Pat. No. 10,034,552, which is a continuation application of U.S. patent application Ser. No. 15/141,223, filed Apr. 28, 2016, now U.S. Pat. No. 9,788,661. These references are each incorporated by reference herein, in their entireties.

TECHNICAL FIELD

The present disclosure generally relates to bedding, and more particularly to bed sheets having performance properties.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that is comfortable, in order to achieve restful sleep.

Typically, a fitted bed sheet is positioned over a mattress and a flat bed sheet is positioned on top of the fitted bed sheet. One or more sleepers position their body(ies) between the fitted bed sheet and the flat bed sheet. However, conventional fitted sheets and flat bed sheets often trap heat and moisture that radiates from the sleeper's body between the fitted bed sheet and the flat bed sheet due to, among other things, the material the flat bed sheet is made from. This causes the temperature of the sleep surface to increase and decreases the ability of your skin regulate itself, which often causes the sleeper to sweat, feel cold and/or clammy, and thus prevents restful sleep. This disclosure describes an improvement over these prior art technologies.

SUMMARY

In one embodiment, in accordance with the principles of the present disclosure, flat and fitted bed sheets are provided. The bed sheets are made from a performance fabric that allows heat and moisture that radiates from the sleeper's body to dissipate through the fitted bed sheet and/or the flat bed sheet. In some embodiments the performance fabric is a knitted fabric including but not limited to a warp knitted performance fabric, a weft knitted performance fabric and a circular knitted performance fabric. In some embodiments, the performance fabric is a circular knitted performance fabric having a plurality of spaced apart ventilation ports. The circular knitted performance fabric has a gauge per square inch, grams per square meter, air permeability and material content that are pre-selected to provide the circular knitted performance fabric with one or more selected physical features.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
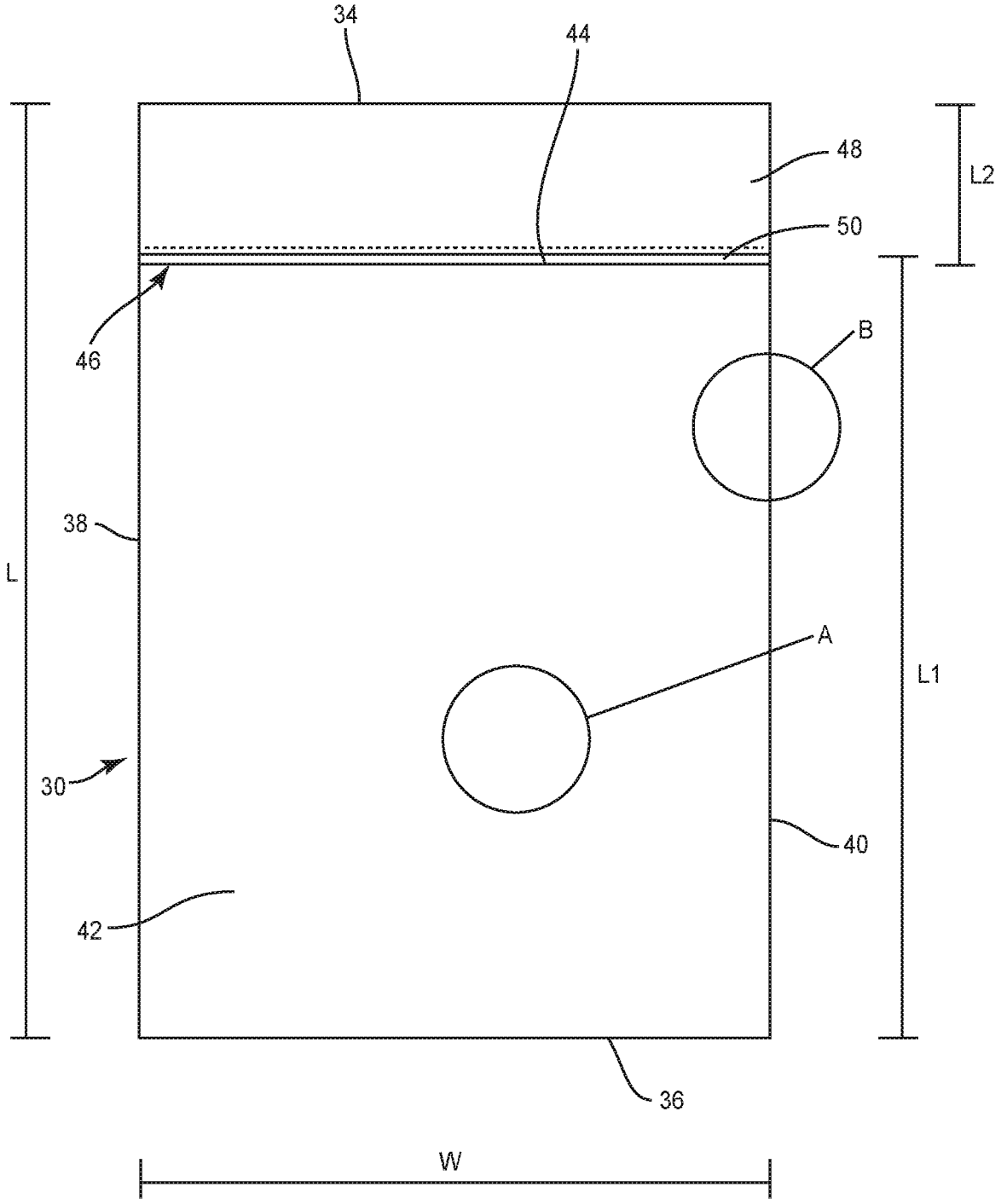
FIG. 1 is a top view of a bed sheet in accordance with the principles of the present disclosure.

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" or "top" and "bottom" are relative and used only in the context to the other, and are not necessarily "superior" and "inferior".

The following discussion includes a description of bed sheets in accordance with the principles of the present disclosure. Alternate embodiments are also disclosed. Reference will now be made in detail to the exemplary embodiments of the present disclosure, which are illustrated in the accompanying figures. Turning to FIGS. 1-11, there are illustrated a sheet set that includes a flat bed sheet 30 and a fitted bed sheet 32.

Bed sheet 30 is configured to be positioned on top of a fitted sheet, such as, for example, bed sheet 32, that is positioned on a mattress. It is envisioned that bed sheets 30, 32 may be used separately, or together. In some embodiments, bed sheet 30 is configured to cover all or a portion of a top surface of the mattress. In some embodiments, bed sheet 30 is configured to be larger than the top surface of the mattress such that at least a portion of bed sheet 30 covers all or a portion of a side surface of the mattress. In some embodiments, bed sheet 30 has substantially the same size and shape as the top surface of the mattress. In some embodiments, the mattress is a standard size mattress, such as, for example, a twin mattress, a full mattress, a queen mattress, a king mattress, or a California king mattress. In some embodiments, the mattress is a crib mattress. In some embodiments, the mattress is a memory foam mattress, an orthopedic mattress (with or without springs), a foam mattress, a mattress that includes gel, a crib mattress, a couch mattress or lounge pad.

Bed sheet 30 extends from a top surface 34 to an opposite bottom surface 36 and from a side surface 38 to an opposite side surface 40. Side surfaces 38, 40 each extend between top and bottom surfaces 34, 36. Bed sheet 30 has a length L defined by the distance from top surface 34 to bottom surface 36 and a width W defined by the distance from side surface 38 to side surface 40. In some embodiments, length L is about 96 inches. In some embodiments, length L is about 102 inches. In some embodiments, length L is about 106 inches. In some embodiments, length L is between about 96 inches and about 106 inches, such as, for example, about 97 inches, about 98 inches, about 99 inches, about 100 inches, about 101 inches, about 102 inches, about 103 inches, about 104 inches, or about 105 inches. In some embodiments, length L is greater than 106 inches. In some embodiments, width W is about 71 inches. In some embodiments, width W is about 86 inches. In some embodiments, width W is about 96 inches. In some embodiments, width W is about 105 inches. In some embodiments, width W is about 110 inches. In some embodiments, width W is between about 71 inches and about 110 inches, such as, for example, about 72 inches, about 73 inches, about 74 inches, about 75 inches, about 76 inches, about 77 inches, about 78 inches, about 79 inches, about 80 inches, about 81 inches, about 82 inches, about 83 inches, about 84 inches, about 85 inches, about 86 inches, about 87 inches, about 88 inches, about 89 inches, about 90 inches, about 91 inches, about 92 inches, about 93 inches, about 94 inches, about 95 inches, about 96 inches, about 97 inches, about 98 inches, about 99 inches, about 100 inches, about 101 inches, about 102 inches, about 103 inches, about 104 inches, about 105 inches, about 106 inches, about 107 inches, about 108 inches, or about 109 inches. In some embodiments, width W is greater than about 76.5 inches. In some embodiments, width W is greater than about 110 inches.

In some embodiments, bed sheet 30 includes various fabrics that are configured to allow moisture and warm air from a sleeper's body to dissipate away from the sleeper, thus preventing the warm air from circulating back to the sleep surface. At the same time, ambient air from the external environment may pass through bed sheet 30 to the sleeper. In some embodiments, bed sheet 30 comprises a portion 42 that is made of a performance fabric. In some embodiments, portion 42 defines bottom surface 36, a section of side surface 38 and a section of side surface 40, as shown in FIG. 1. Portion 42 thus has a width that is equal to width W discussed above. Portion 42 has a length L1 from an upper surface 44 of portion 42 to bottom surface 36. In some embodiments, length L1 is about 92 inches. In some embodiments, length L1 is about 100 inches. In some embodiments, length L1 is about 102 inches. In some embodiments, length L1 is between about 92 inches and about 102 inches, such as, for example, about 93 inches, about 94 inches, about 95 inches, about 96 inches, about 97 inches, about 98 inches, about 99 inches, about 100 inches, or about 101 inches. In some embodiments, length L1 is greater than 102 inches.

Upper surface 44 of portion 42 is coupled to a lower surface 46 of a hem 48 that defines top surface 34, as also shown in FIG. 1. Hem 48 extends from side surface 38 to side surface 40. Hem 48 has a width that is equal to width W. Hem 48 has a length L2 from top surface 34 to lower surface 46. In some embodiments, length L1 and length L2 combine to length L. In some embodiments, length L2 is between about 0.25 inches and 6 inches. In some embodiments, length L2 is about 1 inch. In some embodiments, length L2 is about 2 inches. In some embodiments, length L2 is about 3 inches. In some embodiments, length L2 is about 4 inches. In some embodiments, length L2 is greater than 5 inches. In some embodiments, hem 48 is a Jersey fabric hem. In some embodiments, hem 48 is a type of polyester knit construction. In some embodiments, hem 48 comprises a Sateen fabric, of polyester and/or nylon weave construction. In some embodiments, hem 48 comprises a Twill fabric, of polyester and/or nylon weave construction. In some embodiments, hem 48 comprises another construction, such as, for example, knit, or woven, or otherwise formed, natural fabric such as cotton, linen or wool, etc. and/or knit, woven or otherwise formed man-made fabric such as ripstop nylon, rayon, polyester, other polymers and co-polymers, etc. In some embodiments, piping, such as, for example, satin cord 50 joins upper surface 44 with lower surface 46. In some embodiments, there is no hem, nor piping.

In some embodiments, the performance fabric that makes up portion 42 is warp knitted. In some embodiments, the performance fabric that makes up portion 42 is warp knitted and includes many yarns that are knit to together, as opposed to one yarn knit to the end. In some embodiments, the performance fabric that makes up portion 42 is produced by circular knitting. In some embodiments, the circular knitting process includes circularly knitting yarn or other material into a fabric, such as, for example, a performance fabric. Circular knitting may include organizing knitting needles into a circular knitting bed. The knitting needles produce a circular fabric that is in a tubular form through the center of the cylinder. The circular fabric is then cut to produce portion 42 such that portion 42 has a square or rectangular shape. This allows portion 42 to be formed from a single, continuous piece of performance fabric that is produced using circular knitting. As such, portion 42 extends from side surface 38 to side surface 40 without including any seams between side surface 38 and side surface 40. Portion 42 also extends from upper surface 44 to bottom surface 36 without including any seams between upper surface 44 and bottom surface 36.

In some embodiments, the performance fabric that makes up portion 42 undergoes finishing processes, such as, for example, dyeing, setting and/or rolling (packing) after the circular knitting process described herein. In some embodiments, the performance fabric that makes up portion 42 undergoes finishing processes, such as, for example, dyeing, setting and/or rolling (packing) before the circular knitting process described herein. In some embodiments, the performance fabric that makes up portion 42 undergoes finishing processes, such as, for example, dyeing, setting and/or rolling (packing) during the circular knitting process described herein. In some embodiments, the heat setting is done at about 120° C. at about 10 yards/minute. In some embodiments, the performance fabric that makes up portion 42 is washed before, during or after the circular knitting process described herein. In some embodiments, the performance fabric that makes up portion 42 is washed at a pH level of about 2.0 to about 9.0. In some embodiments, the washing at a pH level of about 2.0 to about 9.0 is a pre-treatment wherein pH levels are acidic or faintly acidic for health and to be comfortable to the skin. In some embodiments, the performance fabric that makes up portion 42 is washed at a pH level of about 4.0 to about 7.0. In some embodiments, the performance fabric that makes up portion 42 is treated with a mixing agent before, during or after the circular knitting process described herein. In some embodiments, the mixing agent is a smoothing agent. In some embodiments, the mixing agent comprises dimethyl terephthalate, ethylene glycol and/or polyethylene glycol. In some embodiments, the mixing agent is applied at a dosage between about 1% to about 10%. In some embodiments, the mixing agent is applied at a dosage between about 4% to about 6%. In some embodiments, the mixing agent is applied at a dosage of about 5%. In some embodiments, the mixing agent is applied at a dosage greater than about 10%.

In some embodiments, the performance fabric that makes up portion 42 is treated with a mixing agent before, during or after the circular knitting process described herein.

In some embodiments, the circular knitted performance fabric that makes up portion 42 is a 100% polyester knit jersey cotton fabric. In some embodiments, the circular knitted performance fabric that makes up portion 42 includes a single layer. In some embodiments, the circular knitted performance fabric that makes up portion 42 includes a plurality of layers. In some embodiments, the circular knitted performance fabric that makes up portion 42 includes three layers, such as, for example, a top layer, a bottom layer and a middle layer between the top and bottom layers. In some embodiments, the bottom layer is a flat layer. In some embodiments, the bottom layer is a flat layer that contains more than 500 yarns. In some embodiments, the middle layer is a kind of filling that links the top and bottom layers. In some embodiments, the top layer is less dense than the bottom layer. In some embodiments, the top layer includes less yarns than the bottom layer. In some embodiments, the top layer has about 375 yarns.

Figure 2:
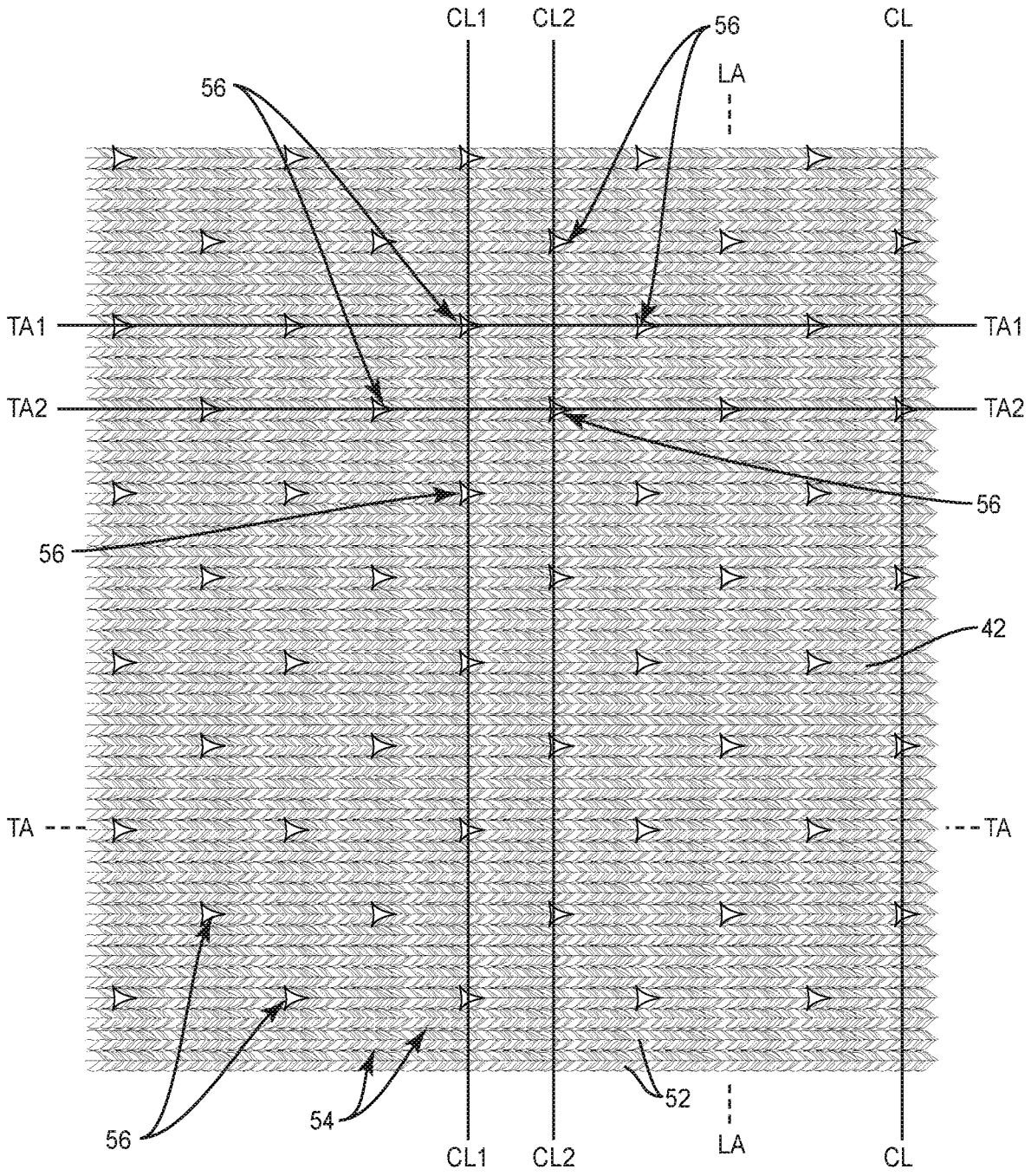
FIG. 2 is a top, close up view of the bed sheet shown in FIG. 1 at detail A in FIG. 1.
Figure 3:
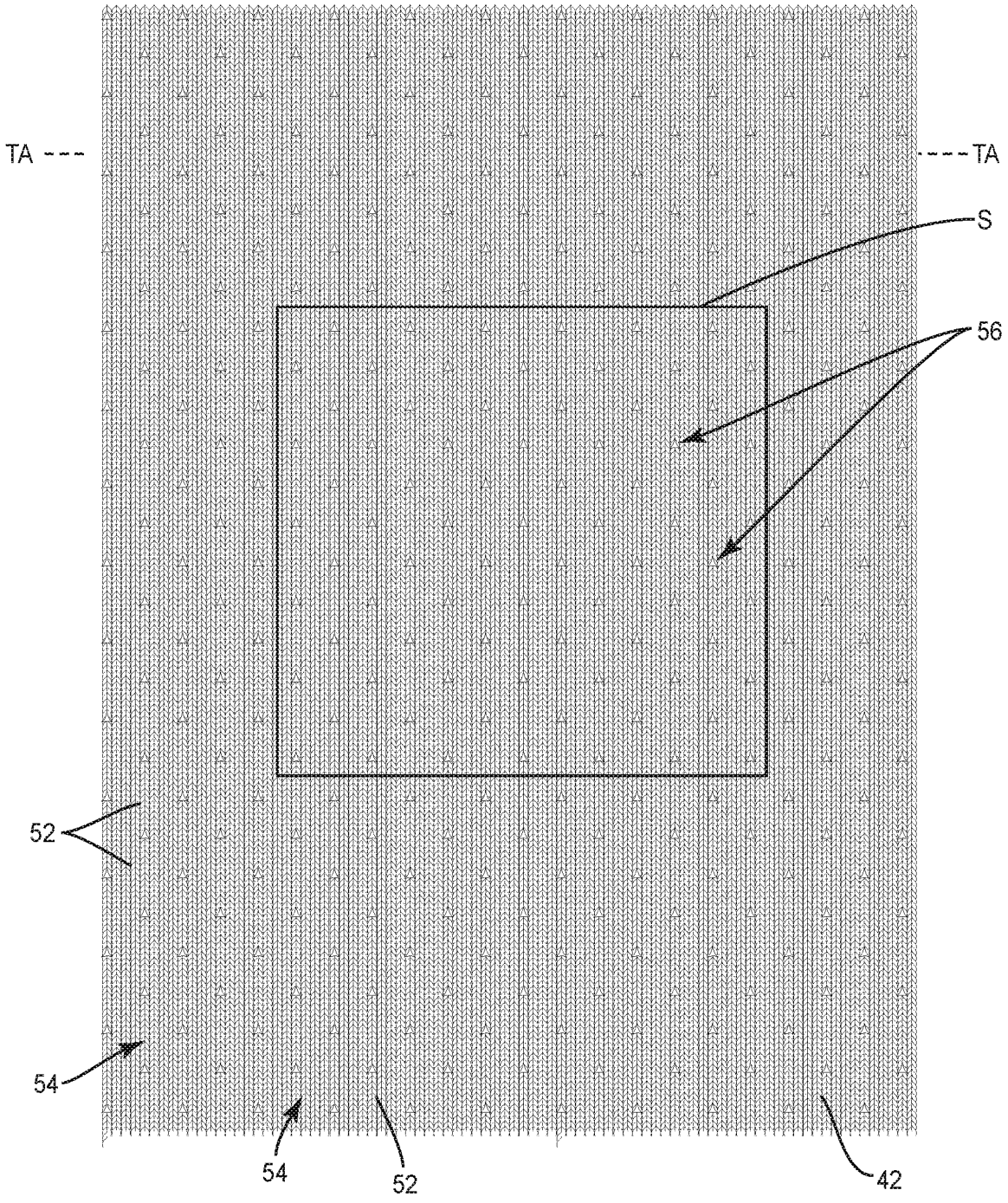
FIG. 3 is a top, close up view of the bed sheet shown in FIG. 1 at detail A in FIG. 1.

In some embodiments, the circular knitted performance fabric that makes up portion 42 comprises a plurality of strands 52, as shown in FIGS. 2 and 3. Strands 52 each extend along a longitudinal axis LA. In some embodiments, strands 52 include bunches of thick yarns and a single thin yarn. In some embodiments, the single yarn is positioned between the bunches of thick yarn. That is, between every certain bunches of the thick yarns, there is a single thin yarn. In some embodiments, strands 52 include two groups of yarns that are strongly twisted together. In some embodiments, strands 52 have a yarn count of about 70 Denier (D) to about 120 D. In some embodiments, strands 52 have a yarn count of about 77.2 D. In some embodiments, strands 52 have yarn count of about 100 D at 96° F. In some embodiments, strands 52 each comprises a material selected from a group consisting of acrylic, acetate, cotton, linen, silk, polyester, other polymers, wool, nylon, rayon, spandex, lycra, hemp, manmade materials, natural materials and blends or combinations thereof. In some embodiments, strands 52 each comprises a material having a melting point between about 200° C. and about 300° C. In some embodiments, strands 52 each comprises a material having a melting point between about 250° C. and about 270° C. In some embodiments, strands 52 each comprises a material having a melting point between about 255° C. and about 260° C. In some embodiments, strands 52 are each made from the same material, such as, for example, one of the materials discussed herein. In some embodiments, strands 52 each have the same gauge and/or denier. In some embodiments, adjacent strands 52 are made from different materials, such as, for example, one of the materials discussed herein and/or have different gauges and/or deniers. In some embodiments, strands have a gauge or denier from about 50 D to about 300 D. In some embodiments, side surface 38 and/or side surface 40 extend parallel to longitudinal axis LA. In some embodiments, top surface 34 and/or bottom surface 36 extend parallel to longitudinal axis LA.

Adjacent strands 52 define a plurality of pores 54 therebetween. The adjacent strands 52 are joined together at portions along longitudinal axis LA to space pores 54 apart from one another. In some embodiments, pores 54 between adjacent strands 52 are spaced apart from one another along longitudinal axis LA. In some embodiments, pores 54 between adjacent strands 52 each have the same size or substantially the same size and/or are uniformly spaced apart from one another along longitudinal axis LA. In some embodiments, pores 54 are variously shaped, such as, for example, oval, oblong, triangular, square, polygonal, irregular, uniform, non-uniform, offset, staggered, undulating, arcuate, variable and/or tapered.

As strands 52 are knitted together using the circular knitting process described above to form the circular knitted performance fabric that makes up portion 42, the machine that knits strands 52 together drops a stitch to provide the circular knitted performance fabric that makes up portion 42 with a plurality of spaced apart ventilation ports 56, shown in FIGS. 2 and 3. In embodiments wherein the circular knitted performance fabric that makes up portion 42 comprises top, middle and bottom layers, as discussed herein, the top layer forms ventilation ports 56. In some embodiments, ventilation ports 56 are formed by hooking one of the thin single strands 52 discussed herein with a bunch of the thin strands 52 discussed herein. That is, the single thin yarn hooks the bunch of thick yarn in one line to form the next line to form one of ventilation ports 56. As such, the bunch of thick yarns "drop" to its neighbor lane/line to form one of ventilation ports 56. The bunch of thick yarns then continues certain lines to form a plain area. In some embodiments, the plain area does not include any ventilation ports 56. The single thin yarn appears again, and ventilation ports 56 repeat. In some embodiments, the circular knitted performance fabric that makes up portion 42 includes a single layer and ventilation ports 56 are formed by hooking the single yarn to form ventilation ports 56. In some embodiments, strands 52 include two groups of yarns that are strongly twisted together. Ventilation ports 56 are formed between the twists.

In some embodiments, the circular knitted performance fabric that makes up portion 42 is formed using a mold. In some embodiments, the mold forms a design. In some embodiments, the mold or design is made by a computer in advance. The mold defines positions for ventilation ports 56. That is, the mold provides a pattern of spaced apart ventilation ports 56. This allows yarns to be fed into a machine to follow the mold or design such that the yarns fill the spaces between the positions for ventilation ports 56. In some embodiments, the yarns are fed in bunches, such as, for example, 2 yarns, 3 yarns, 4 yarns, etc. In some embodiments, the bunches of yarns are twisted together. This allows the yarns to form ventilation ports 56 when the yarns come out of the machine. In some embodiments, the fabric is subjected to a finishing process to stabilize ventilation ports 56. That is, the fabric may go through a high temperature finishing to stabilize ventilation ports 56. In some embodiments, the high temperature finishing comprises a finishing process at 200° C. or more.

In some embodiments, ventilation ports 56 are uniformly spaced apart from one another. Ventilation ports 56 are each spaced apart from pores 54 by at least one of strands 52. In some embodiments, ventilation ports 56 each have the same size or substantially the same size and are larger than pores 54. Ventilation ports 56 are thus distinct from pores 54.

In some embodiments, ventilation ports 56 are variously shaped, such as, for example, oval, oblong, triangular, square, polygonal, irregular, uniform, non-uniform, offset, staggered, undulating, arcuate, variable and/or tapered. In some embodiments, ventilation ports 56 are each between about 1.5 to about 10 times greater in size than each of pores 54. In some embodiments, ventilation ports 56 are about 2 times greater in size than each of pores 54. In some embodiments, ventilation ports 56 are about 2.5 times greater in size than each of pores 54. In some embodiments, ventilation ports 56 are about 3 times greater in size than each of pores 54. In some embodiments, ventilation ports 56 are about 3.5 times greater in size than each of pores 54. In some embodiments, ventilation ports 56 are about 4 times greater in size than each of pores 54. In some embodiments, ventilation ports 56 are about 4.5 times greater in size than each of pores 54. In some embodiments, ventilation ports 56 are about 5 times greater in size than each of pores 54. In some embodiments, ventilation ports 56 are about 5.5 times greater in size than each of pores 54. In some embodiments, ventilation ports 56 are about 6 times greater in size than each of pores 54. In some embodiments, ventilation ports 56 are about 6.5 times greater in size than each of pores 54. In some embodiments, ventilation ports 56 are about 7 times greater in size than each of pores 54. In some embodiments, ventilation ports 56 are about 7.5 times greater in size than each of pores 54. In some embodiments, ventilation ports 56 are about 8 times greater in size than each of pores 54. In some embodiments, ventilation ports 56 are about 8.5 times greater in size than each of pores 54. In some embodiments, ventilation ports 56 are about 9 times greater in size than each of pores 54. In some embodiments, ventilation ports 56 are about 9.5 times greater in size than each of pores 54. In some embodiments, ventilation ports 56 are more than about 10 times greater in size than each of pores 54.

In some embodiments, ventilation ports 56 are arranged in parallel columns CL, each of columns CL comprising a plurality of ventilation ports 56, as shown in FIG. 2. In some embodiments, columns CL each extend parallel to longitudinal axis LA. Columns CL are spaced apart from one another along a transverse axis TA. In some embodiments, transverse axis TA extends perpendicular to longitudinal axis LA. In some embodiments, side surface 38 and/or side surface 40 extend parallel to transverse axis TA. In some embodiments, top surface 34 and/or bottom surface 36 extend parallel to transverse axis TA. Ventilation ports 56 in each column CL are spaced apart from one another along longitudinal axis LA such that ventilation ports 56 in each column CL are coaxial with one another.

In some embodiments, one of ventilation ports 56 in a first column CL1 intersects a first transverse axis TA1 and one of ventilation ports 56 in a second column CL2 intersects a second transverse axis TA2. Ventilation ports 56 are configured such that first transverse axis TA1 does not intersect of any of ventilation ports 56 in second column CL2 and second transverse axis TA2 does not intersect of any of ventilation ports 56 in first column CL1, as shown in FIG. 2. This configuration provides sufficient spacing between ventilation ports 56 along both longitudinal axis LA and transverse axis TA to allow enough air to flow through bed sheet 30. This prevents air that radiates from a sleeper's body to become trapped between bed sheet 30 and a mattress, thus providing ventilation that results in a cool sleep surface. First and second columns CL1, CL2 extend parallel to one another. First and second transverse axes TA1, TA2 extends parallel to one another. In some embodiments, transverse axes TA1, TA2 extend perpendicular to first and second columns CL1, CL2. First column CL1 is adjacent to second column CL2. That is, there are no columns CL between first and second columns CL1, CL2.

The circular knitted performance fabric that makes up portion 42 includes a plurality of pores 54 and ventilation ports 56, as discussed above. That is, a given section of the knitted performance fabric, such as, for example section S shown in FIG. 3, includes a plurality of pores 54 and ventilation ports 56. In some embodiments, section S is one square inch in size and comprises at least 50 ventilation ports 56. In some embodiments, section S is one square inch in size and comprises at least 50 ventilation ports 56. In some embodiments, section S is one square inch in size and comprises between about 50 and about 100 ventilation ports 56. In some embodiments, section S is one square inch in size and comprises between about 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98 or 99 ventilation ports 56. In some embodiments, section S is one square inch in size and comprises between about 100 and about 200 ventilation ports 56. In some embodiments, FIG. 2 and/or FIG. 3 are drawn to scale to show the relative sizes and spacing of pores 54 and/or ventilation ports 56.

The material or materials that the circular knitted performance fabric that makes up portion 42 is/are made from, pores 54 and ventilation ports 56 makes the circular knitted performance fabric lightweight. In some embodiments, that the circular knitted performance fabric that makes up portion 42 has a weight between about 75 and about 125 grams per square meter (gsm). In some embodiments, that the circular knitted performance fabric that makes up portion 42 has a weight between about 90 and about 110 gsm. In some embodiments, that the circular knitted performance fabric that makes up portion 42 has a weight of about 91 gsm, about 92 gsm, about 93 gsm, about 94 gsm, about 95 gsm, about 96 gsm, about 97 gsm, about 98 gsm, about 99 gsm, about 100 gsm, about 101 gsm, about 102 gsm, about 103 gsm, about 104 gsm, about 105 gsm, about 106 gsm, about 107 gsm, about 108 gsm, or about 109 gsm. In some embodiments, that the circular knitted performance fabric that makes up portion 42 has a weight greater than about 100 gsm. In some embodiments, that the circular knitted performance fabric that makes up portion 42 has a weight greater than about 110 gsm. In some embodiments, that the circular knitted performance fabric that makes up portion 42 has a weight greater than about 125 gsm.

In some embodiments, section S is one square inch in size and comprises a gauge and/or denier of about 20 D to about 35 D. In some embodiments, section S is one square inch in size and comprises a gauge and/or denier of about 28 D. In some embodiments, section S is one square inch in size and comprises a gauge and/or denier greater than 35 D.

Pores 54 and ventilation ports 56 make the circular knitted performance fabric that makes up portion 42 breathable. In some embodiments, the air permeability of the circular knitted performance fabric is between about 600 cubic feet per minute (cfm) and about 900 cfm. In some embodiments, the air permeability of the circular knitted performance fabric is between about 700 cfm and about 750 cfm. In some embodiments, the air permeability of the circular knitted performance fabric greater than about 600 cfm. In some embodiments, the air permeability of the circular knitted performance fabric is about 736 cfm.

Figure 4:
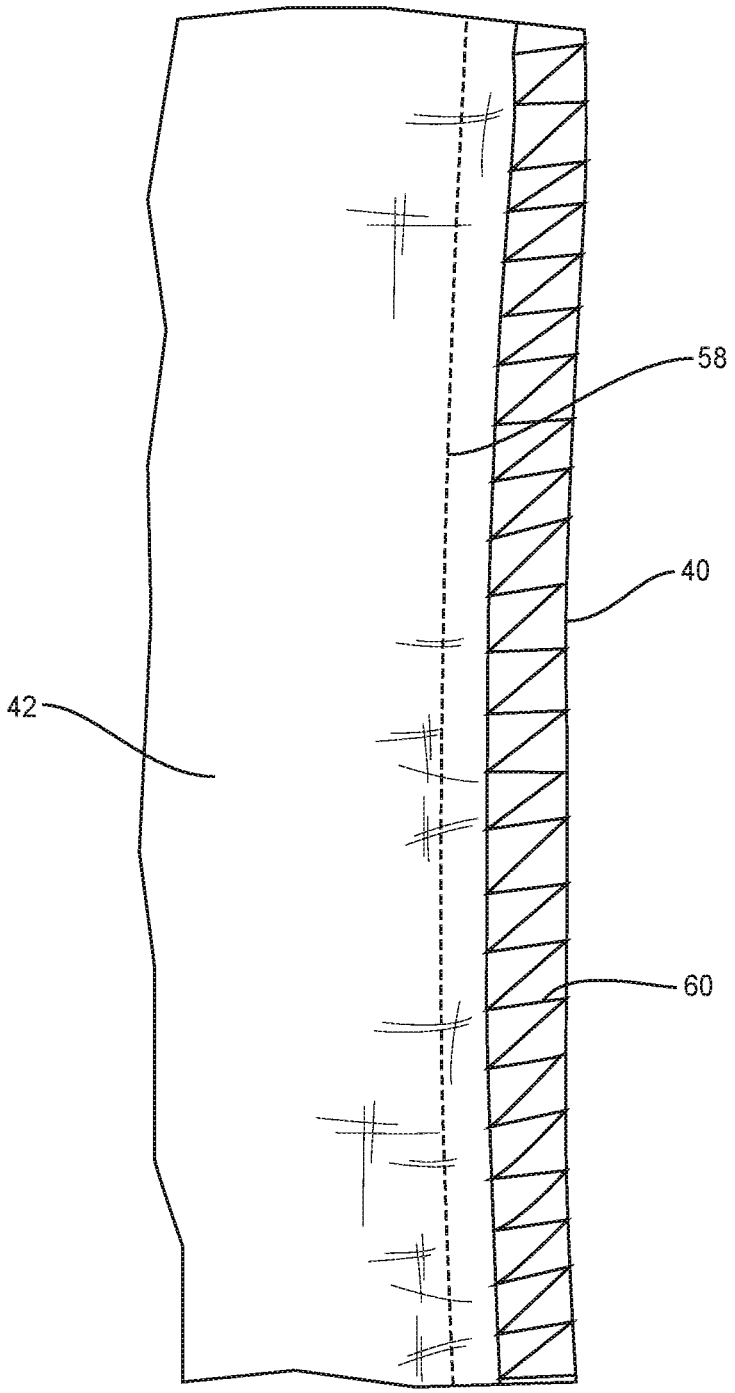
FIG. 4 is a top, close up view of the bed sheet shown in FIG. 1 at detail B in FIG. 1.
Figure 5:
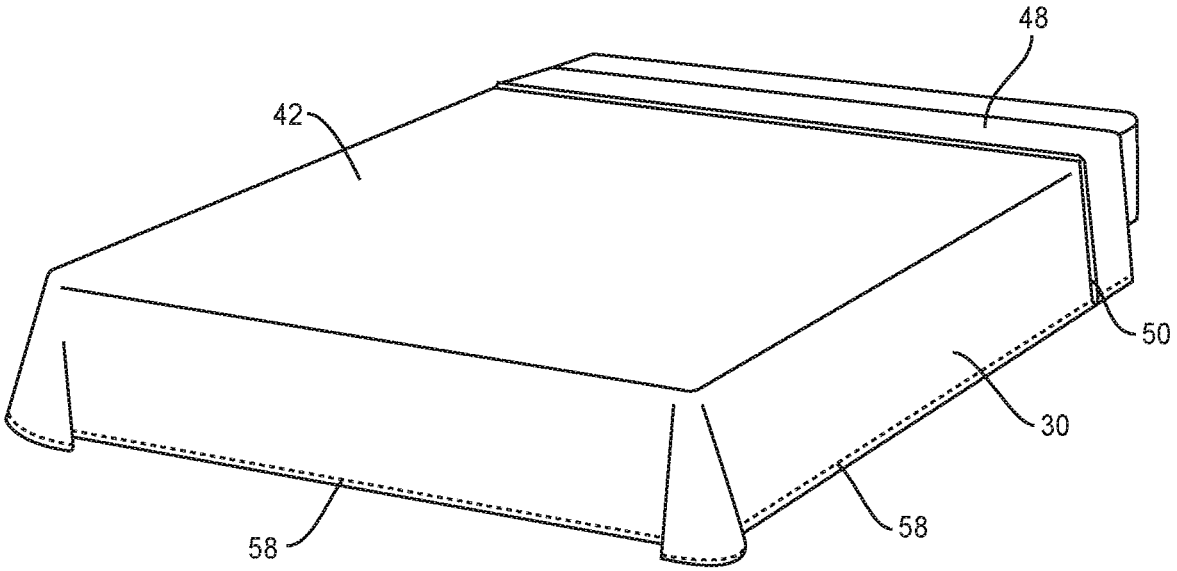
FIG. 5 is a perspective view of the bed sheet shown in FIG. 1.
Figure 6:
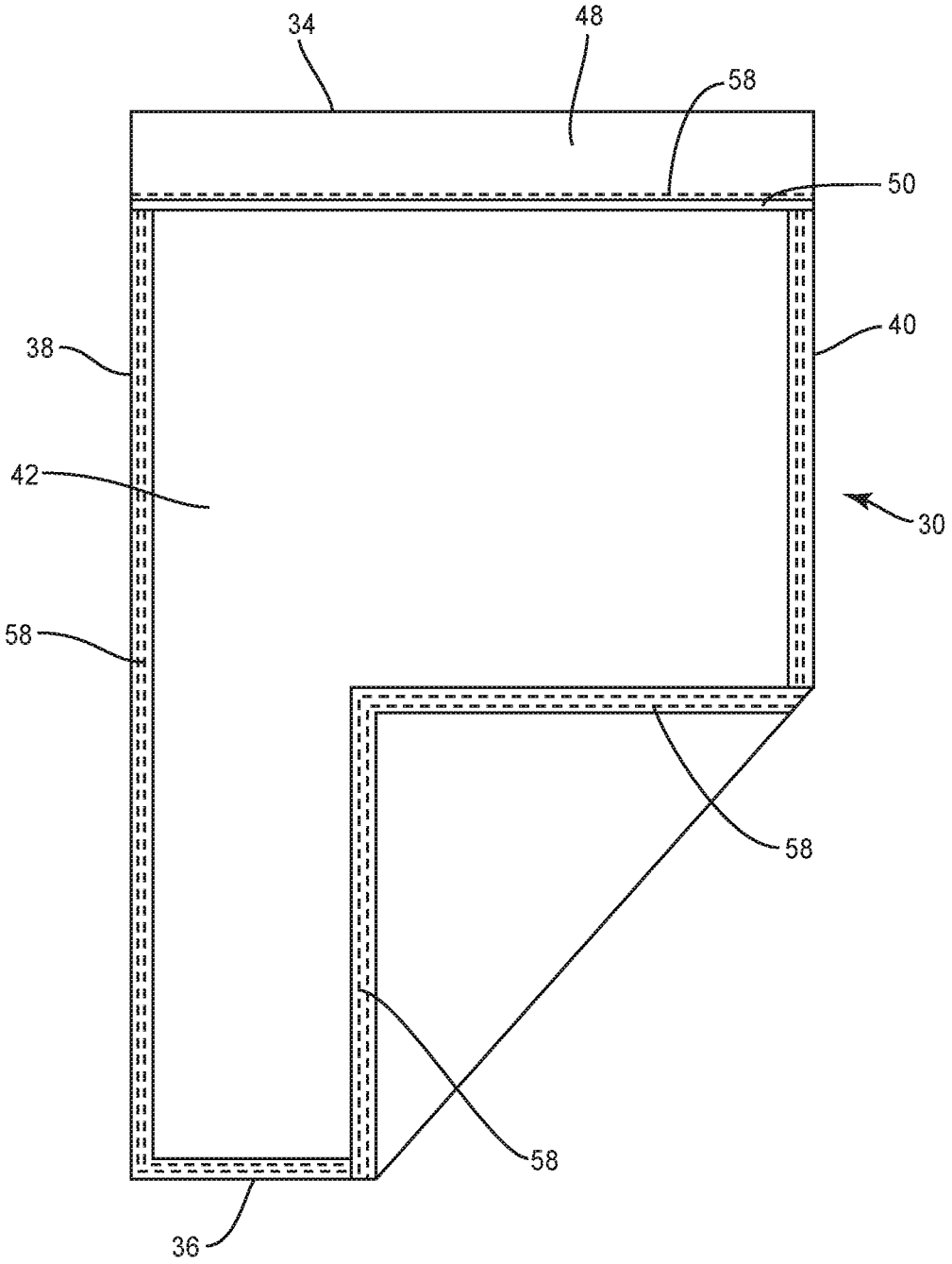
FIG. 6 is a top view of one embodiment of the bed sheet shown in FIG. 1 in accordance with the principles of the present disclosure, with a corner of the bed sheet folded over.
Figure 7:
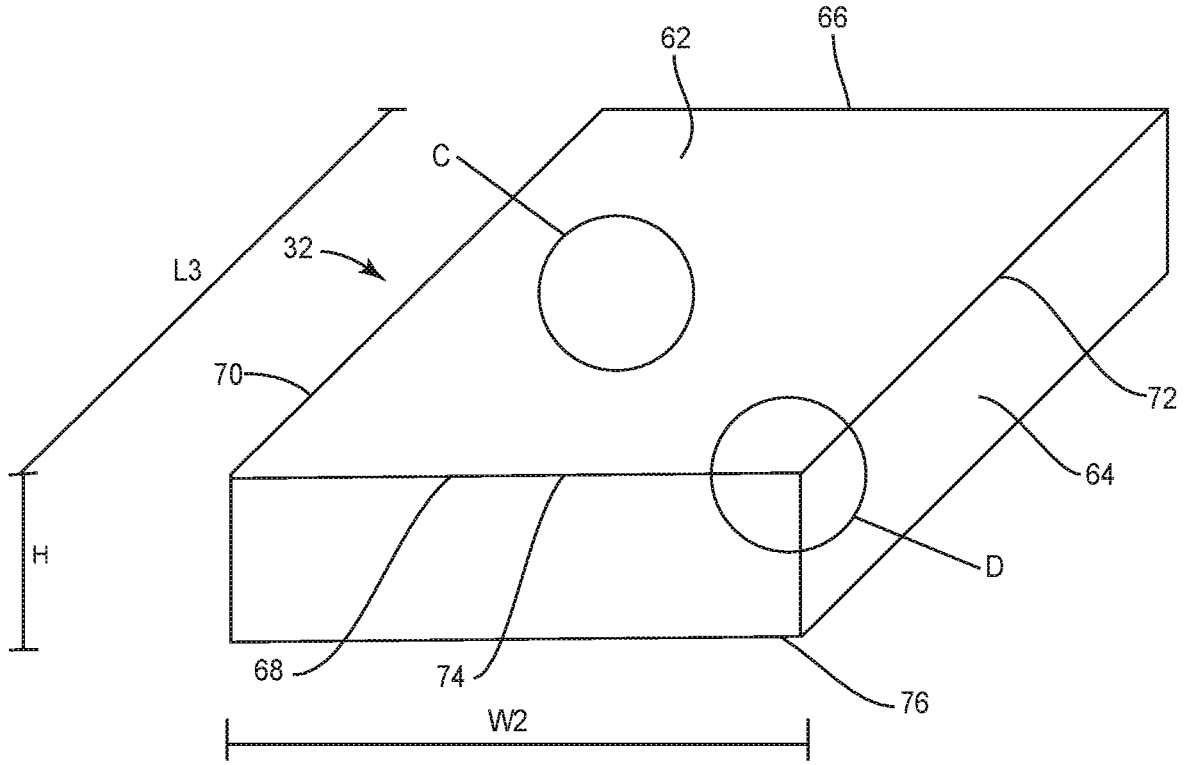
FIG. 7 is a perspective view of a bed sheet in accordance with the principles of the present disclosure.
Figure 8:
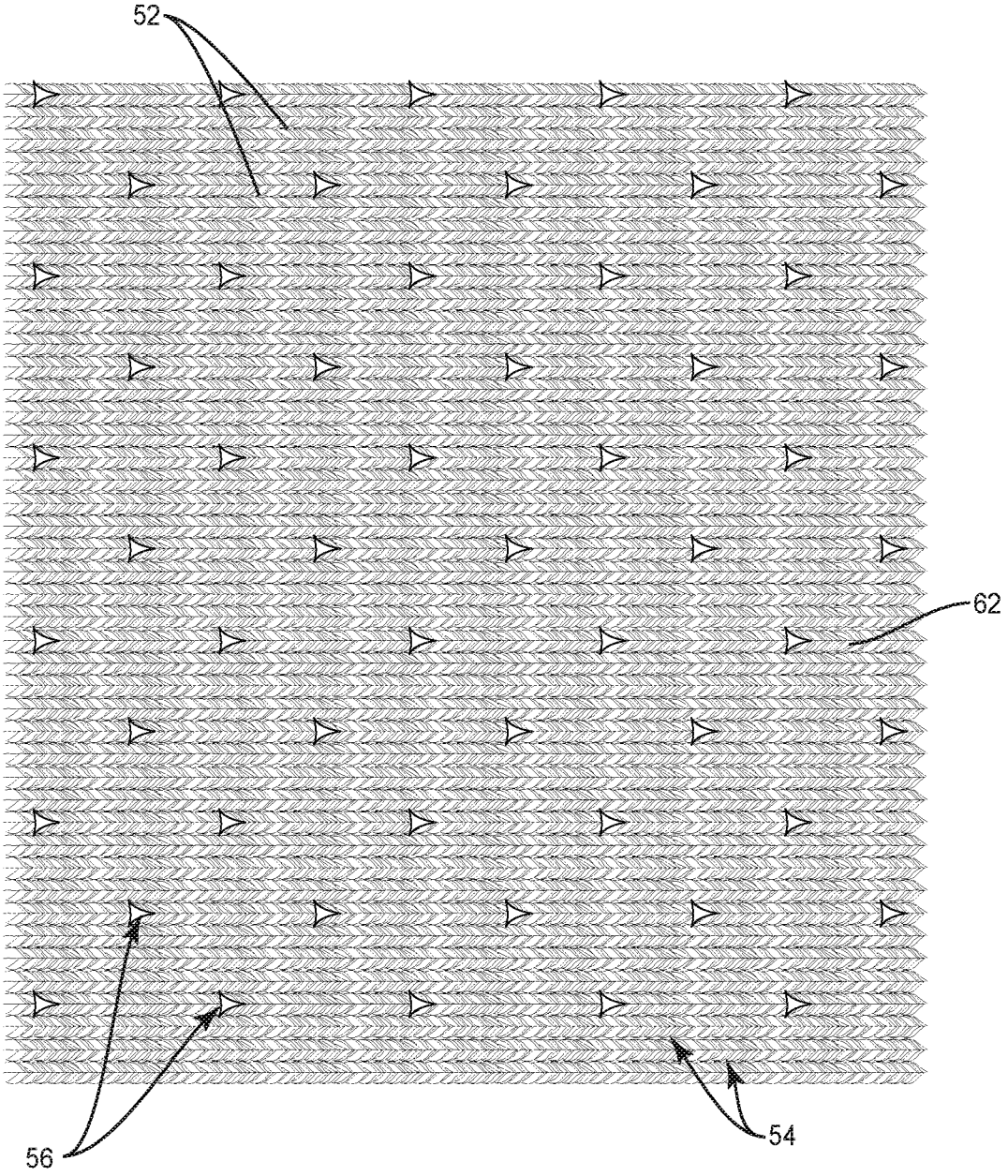
FIG. 8 is a top, close up view of the bed sheet shown in FIG. 7 at detail C in FIG. 7.
Figure 9:
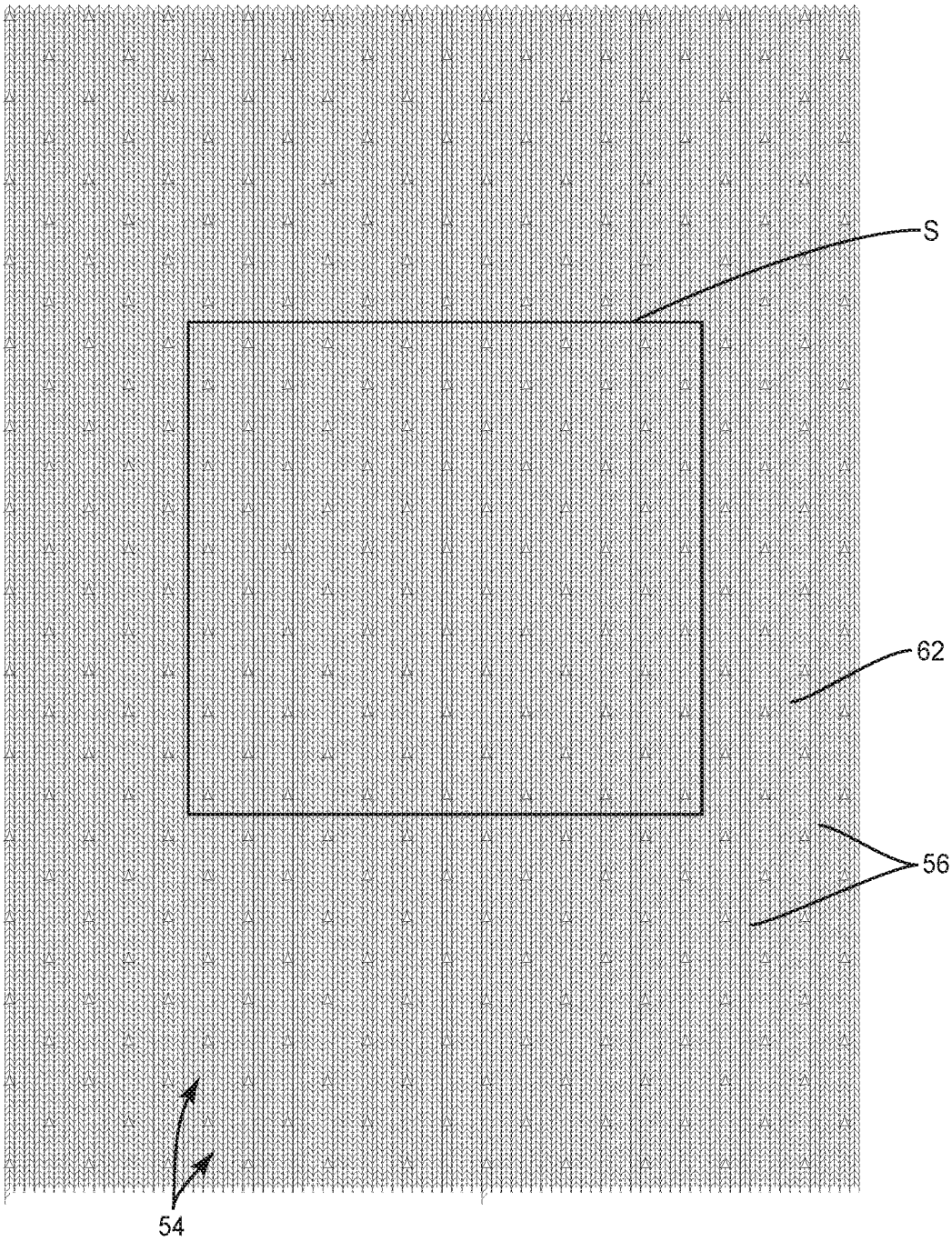
FIG. 9 is a top, close up view of the bed sheet shown in FIG. 7 at detail C in FIG. 7.

In one embodiment, shown in FIGS. 4-6, bed sheet 30 comprises stitching 58 about all or a portion of a perimeter of portion 42. That is, stitching 58 extends along top surface 34 adjacent to an edge of top surface 34, along bottom surface 36 adjacent to an edge of bottom surface, alongside surface 38 adjacent to an edge of side surface 38 and/or alongside surface 40 adjacent to an edge of side surface 40. In some embodiments, stitching 58 along top surface 34 is spaced apart from stitching 58 alongside surfaces 38, 40. In some embodiments, stitching 58 along top surface 34 is continuous with stitching 58 alongside surfaces 38, 40. In some embodiments, stitching 58 along bottom surface 36 is spaced apart from stitching 58 alongside surfaces 38, 40. In some embodiments, stitching 58 along bottom surface 36 is continuous with stitching 58 alongside surfaces 38, 40. In some embodiments, stitching 58 along top surface 34 extends parallel to top surface 34, stitching 58 along bottom surface 36 extends parallel to bottom surface 36, stitching 58 alongside surface 38 extends parallel to side surface 38 and/or stitching 58 alongside surface 40 extends parallel to side surface 40. In some embodiments, stitching is a single needle edgestitch. In some embodiments, stitching is a single needle edgestitch with a turn back, such as, for example a ⅝ inch turn back.

In one embodiment, at least one of top surface 34, bottom surface 36, side surface 38 and side surface 40 include stitching 60 about an edge of top surface 34, bottom surface 36, side surface 38 and/or side surface 40, as shown in FIG. 4. Stitching 60 closes seams of top surface 34, bottom surface 36, side surface 38 and/or side surface 40. In some embodiments, stitching 60 comprises an overlock stitch, such as, for example, a five thread overlock stitch. In some embodiments, stitching 60 comprises a straight stitch having safety chain stitching in place of or in addition to the overlock stitch. In some embodiments, stitching 60 is provided in addition to stitching 58. In some embodiments, stitching 60 is provided in place of stitching 58.

Bed sheet 32 is configured to be positioned on a mattress. In some embodiments, the mattress is a standard size mattress, such as, for example, a twin mattress, a full mattress, a queen mattress, a king mattress, or a California king mattress. In some embodiments, the mattress is a crib mattress. In some embodiments, the mattress is a memory foam mattress, an orthopedic mattress (with or without springs), a foam mattress, a mattress that includes gel, a crib mattress, a couch mattress or lounge pad.

Bed sheet 32 comprises a portion 62 and a portion 64 that surrounds portion 62. Portion 62 is configured to engage a top surface of a mattress and portion 64 is configured to engage side surfaces of a mattress while portion 60 engages the top surface of the mattress. Portion 62 extends from a top surface 66 to an opposite bottom surface 68 and from a side surface 70 to an opposite side surface 72. Side surfaces 70, 72 each extend between top and bottom surfaces 66, 68. Portion 64 includes an upper surface 74 that engages surfaces 66, 68, 70 and 72 and an opposite lower surface 76.

Portion 62 has a length L3 defined by the distance from top surface 66 to bottom surface 68 and a width W2 defined by the distance from side surface 70 to side surface 72. In some embodiments, length L3 is about 75 inches. In some embodiments, length L3 is about 80 inches. In some embodiments, length L3 is about 84 inches. In some embodiments, length L3 is between about 75 inches and about 84 inches, such as, for example, about 76 inches, about 77 inches, about 78 inches, about 79 inches, about 80 inches, about 81 inches, about 82 inches, or about 83 inches. In some embodiments, length L3 is greater than 84 inches. In some embodiments, width W2 is about 36 inches. In some embodiments, width W2 is about 39 inches. In some embodiments, width W2 is about 54 inches. In some embodiments, width W2 is about 60 inches. In some embodiments, width W2 is about 72 inches. In some embodiments, width W2 is about 78 inches. In some embodiments, width W2 is between about 36 inches and about 78 inches, such as, for example, about 37 inches, about 38 inches, about 39 inches, about 40 inches, about 41 inches, about 42 inches, about 43 inches, about 44 inches, about 45 inches, about 46 inches, about 47 inches, about 48 inches, about 49 inches, about 50 inches, about 51 inches, about 52 inches, about 53 inches, about 54 inches, about 55 inches, about 56 inches, about 57 inches, about 58 inches, about 59 inches, about 60 inches, about 61 inches, about 62 inches, about 63 inches, about 64 inches, about 65 inches, about 66 inches, about 67 inches, about 68 inches, about 69 inches, about 70 inches, about 71 inches, about 72 inches, about 73 inches, about 74 inches, about 75 inches, about 76 inches or about 77 inches. In some embodiments, width W2 is greater than about 78 inches.

In some embodiments, bed sheet 32 includes various surface fabrics that are configured to allow warm air from a sleeper's body to dissipate away from the sleeper, thus preventing the warm air from circulating back to the sleep surface. At the same time, ambient air from the external environment may pass through bed sheet 32 to the sleeper. In some embodiments, at least one of portion 62 and portion 64 is made of a performance fabric. In some embodiments, the performance fabric that portion 62 and/or portion 64 are made from is the same circular knit performance fabric discussed above that portion 42 of bed sheet 30 is made from. In some embodiments, the performance fabric that portion 62 and/or portion 64 are made from is different than the circular knit performance fabric that portion 42 of bed sheet 30 is made from. In some embodiments, portion 62 is made from a different material or materials than portion 64. In some embodiments, portions 62, 64 are each made from the same material(s). In some embodiments, the performance fabric that makes up portion 64 and/or portion 66 is produced by circular knitting, as discussed above with regard to the circular knitted performance fabric that makes up portion 42 of bed sheet 30. This allows portion 62 to be formed from a single, continuous piece of performance fabric that is produced using circular knitting. As such, portion 62 extends from side surface 70 to side surface 72 without including any seams between side surface 70 and side surface 72. Portion 62 also extends from top surface 66 to bottom surface 68 without including any seams between top surface 66 and bottom surface 68.

Portion 64 has a height H from upper surface 74 to lower surface 76. In some embodiments, height H is about 15 inches. In some embodiments, height H is between about 0.25 inches and 30 inches. In some embodiments, height H is about 1 inch. In some embodiments, height H is about 2 inches, about 3 inches, about 4 inches, about 5 inches, about 6 inches, about 7 inches, about 8 inches, about 9 inches, about 10 inches, about 11 inches, about 12 inches, about 13 inches, about 14 inches, about 15 inches, about 16 inches, about 17 inches, about 18 inches, about 19 inches, about 20 inches, about 21 inches, about 22 inches, about 23 inches, about 24 inches, about 25 inches, about 26 inches, about 27 inches, about 28 inches, or about 29 inches.

Figure 10:
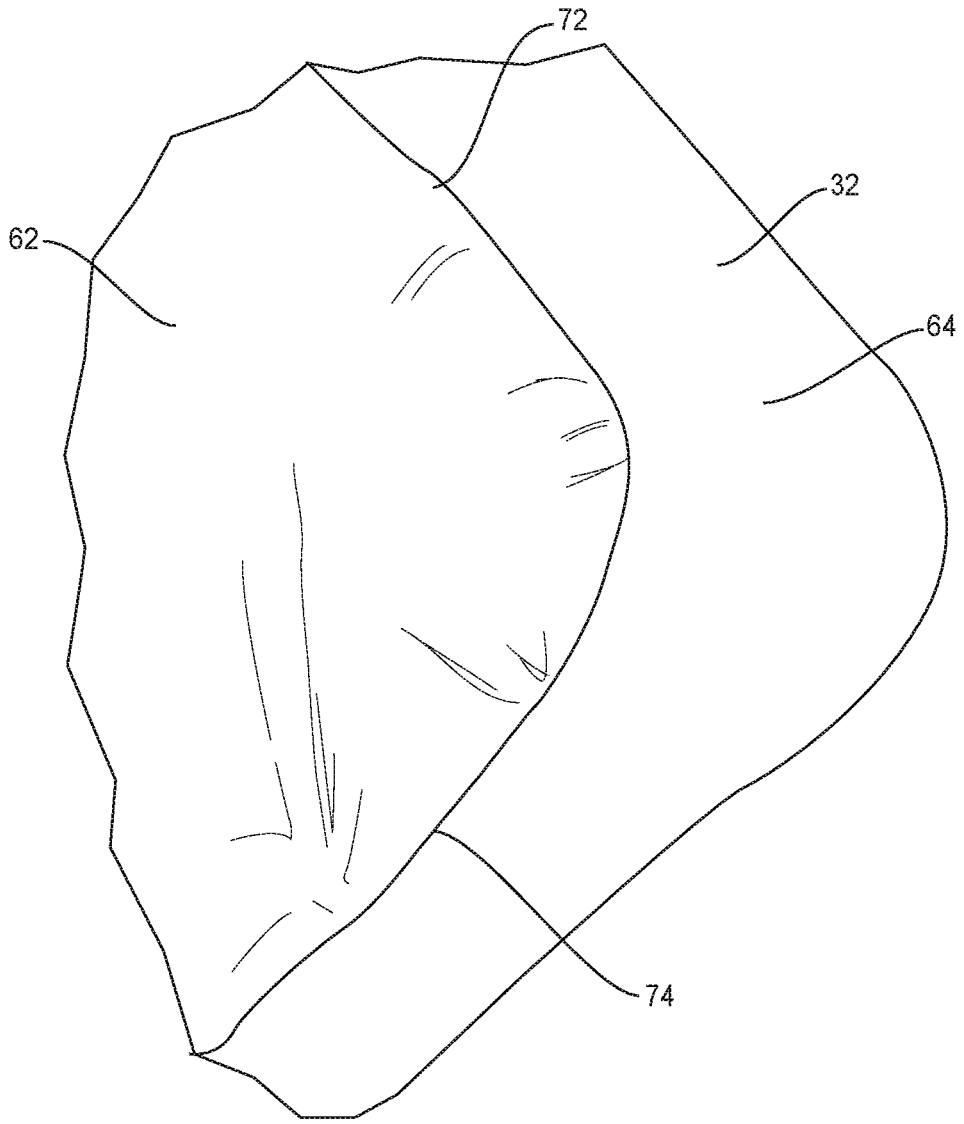
FIG. 10 is a perspective, close up view of the bed sheet shown in FIG. 7 at detail D in FIG. 7.

In one embodiment, shown in FIG. 10, bed sheet 32 includes rounded corners. That is, portion 62 is rounded between top surface 66 and side surface 70, between top surface 66 and side surface 72, between bottom surface 68 and side surface 70 and between bottom surface 68 and side surface 72.

Figure 11:
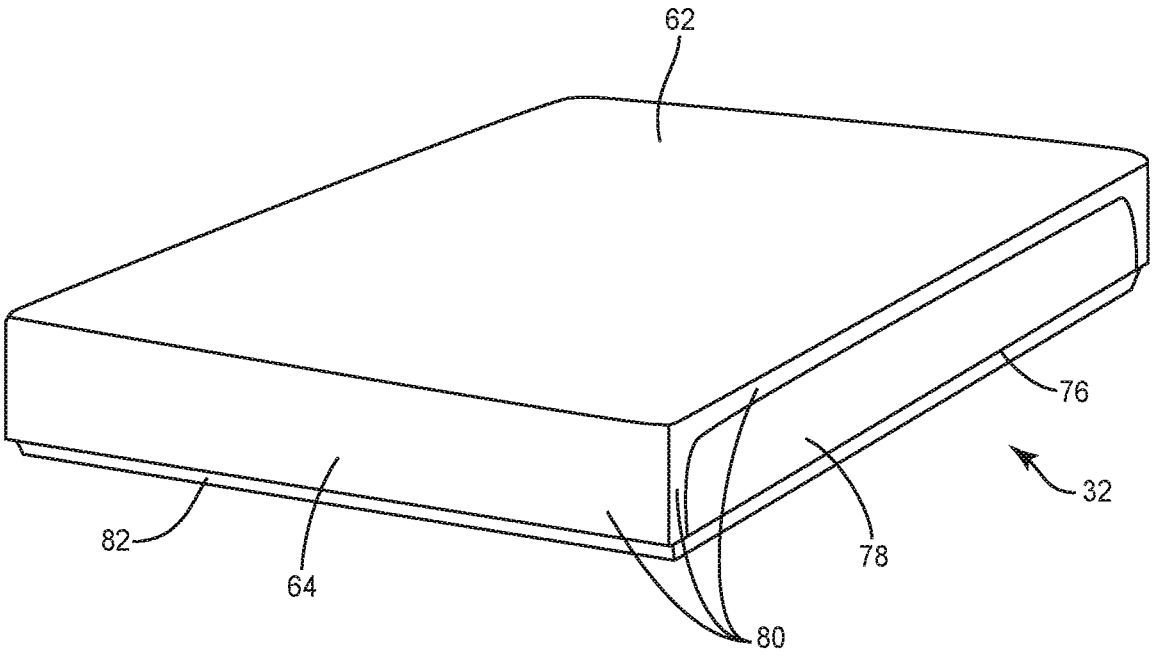
FIG. 11 is a perspective view of one embodiment of the bed sheet shown in FIG. 7 in accordance with the principles of the present disclosure.

In one embodiment, shown in FIG. 11, portion 64 includes a section 78 that is made from a first material and a section 80 that is made from a second material that is different than the first material. In some embodiments, the first material is the circular knitted performance fabric discussed above. In some embodiments, the second material is the circular knitted performance fabric discussed above. Bed sheet 32 includes an elastic band, such as, for example, a power band 82 coupled to lower surface 76 to assist bed sheet 32 remaining on a mattress after bed sheet 32 has been stretched and positioned over the mattress. That is, after bed sheet 32 is stretched from a resting or unstretched state to a stretched state and positioned over the mattress, power band 82 moves from a stretch state back to a resting or unstretched state to maintain bed sheet 32 on the mattress. In some embodiments, power band 82 extends continuously about a perimeter of lower surface 76. In some embodiments, power band 82 includes a plurality of discrete portions that are positioned about a perimeter of lower surface 76.

In addition to the performance fabric being circular knitted, the performance fabric can be a weft knitted performance fabric or a warp knit performance fabric. Weft knits are constructed from one yarn that is fed into knitting needles in a horizontal direction. Either circular or a flat-bed knitting machine can be used to make weft knits. The circular knitting machine creates a spiral effect as it produces a fabric in tubular form. Four basic stiches are used in manufacturing weft knitted fabrics. They are the flat or jersey stitch, purl stich, the rib stitch, double stitch and interlock stitches. In some embodiments, weft knitting can be used to make the performance bed sheet.

In addition to the performance fabric being circular knitted or weft knitted the bed sheet can also be made from warp knit performance fabrics. Warp knit performance fabrics are constructed with yarn loops formed in a vertical or warp direction. All the yarns used in warp knit are placed parallel to each other in a manner similar to the placement of yarns in weaving. In some embodiments, warp knitting can be used to make the performance bed sheet.

It is contemplated that the sheet sets described herein may include one or more products that include and/or are related to bed linens and/or bed coverings, such as, for example, duvet covers, duvets and comforters. It is contemplated that the sheet sets described herein may include one or more pillowcases, wherein at least a portion of the pillowcase is made from the circular knitted performance fabric described herein. It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A mattress covering comprising a knit fabric, the knit fabric being at least partially polyester having a gauge per square inch, grams per square meter, air permeability and material content that are pre-selected to provide the knit fabric with one or more selected physical features, the knit fabric comprising a top layer, a bottom layer and a middle layer between the top layer and the bottom layer, the bottom layer being less permeable than the top layer, the top and bottom layers being formed by a plurality of strands, the strands extending parallel to one another.

2. A mattress covering as recited in claim 1, wherein the top layer allows more air flow therethrough than the bottom layer.

3. A mattress covering as recited in claim 1, wherein the gauge per square inch is between about 1 and about 15.

4. A mattress covering as recited in claim 1, wherein the gauge per square inch is between about 15 and about 25.

5. A mattress covering as recited in claim 1, wherein the gauge per square inch is about 15 or more.

6. A mattress covering as recited in claim 1, wherein the grams per square meter is between about 75 and about 125.

7. A mattress covering as recited in claim 1, wherein the grams per square meter is between about 90 and about 110.

8. A mattress covering as recited in claim 1, wherein the grams per square meter is greater than about 100.

9. A mattress covering as recited in claim 1, wherein the air permeability is between about 600 cubic feet per minute (cfm) and about 900 cfm.

10. A mattress covering as recited in claim 1, wherein the air permeability is between about 700 cubic feet per minute (cfm) and about 750 cfm.

11. A mattress covering as recited in claim 1, wherein the air permeability is greater than 736 cubic feet per minute.

12. A mattress covering as recited in claim 1, wherein the material content comprises cotton-and polyester.

13. A mattress covering as recited in claim 1, wherein the mattress covering extends from a top surface to an opposite bottom surface and has opposite first and second side surfaces that each extend between the top and bottom surfaces, the mattress covering being seamless from the top surface to the bottom surface and from the first side surface to the second side surface.

14. A mattress covering as recited in claim 1, wherein the strands form at least a majority of the knit fabric.

15. A mattress covering as recited in claim 1, wherein the knit fabric consists of the strands.

16. A mattress covering as recited in claim 1, wherein the mattress covering comprises a top portion configured to engage a top surface of a mattress that extends from a top surface to an opposite bottom surface and has opposite first and second side surfaces that each extend between the top and bottom surfaces, the top portion being seamless from the top surface to the bottom surface and from the first side surface to the second side surface.

17. A mattress covering as recited in claim 1, wherein the middle layer comprises a filling that links the top and bottom layers.

18. A mattress covering as recited in claim 1, wherein the knit fabric is free of any ventilation ports.

19. A mattress covering as recited in claim 1, wherein the knit fabric is a performance knit fabric.

20. A mattress covering as recited in claim 1, wherein the knit fabric is a circular knit fabric.

21. A mattress covering as recited in claim 1, wherein the knit fabric is a warp knitted performance fabric.

22. A mattress covering as recited in claim 1, wherein the knit fabric is a weft knitted performance fabric.

23. A mattress covering as recited in claim 1, wherein the mattress covering is an article of bedding selected from the group consisting of bed sheets, mattress protectors, mattress pads and mattress toppers.

24. A mattress covering as recited in claim 1, wherein the knit fabric being a predominately polyester knit fabric.

25. A mattress covering as recited in claim 1, wherein the knit fabric comprises a 100% polyester knit jersey fabric.

26. A mattress covering as recited in claim 1, wherein the knit fabric comprises a fabric that allows moisture from an adjoining body to dissipate away from the body.

27. A mattress covering as recited in claim 1, wherein the strands extend parallel to one another along an entire length of the mattress covering.

* * * * *